US005209199A

United States Patent [19]

Ballhause et al.

[11] Patent Number: 5,209,199

[45] Date of Patent: May 11, 1993

[54] CONTROL APPARATUS FOR TURNING OFF AN INTERNAL COMBUSTION ENGINE

[75] Inventors: Lutz Ballhause, Korb; Erwin Krimmer, Pluederhausen, both of Fed. Rep. of Germany

[73] Assignee: Robert Bosch GmbH, Stuttgart, Fed. Rep. of Germany

[21] Appl. No.: 953,346

[22] Filed: Sep. 30, 1992

[30] Foreign Application Priority Data

Oct. 10, 1991 [DE] Fed. Rep. of Germany ..... 4133557

[51] Int. Cl.[5] ..... F02B 77/00

[52] U.S. Cl. ..... 123/198 DB; 123/510

[58] Field of Search ..... 123/198 DB, 198 D, 510, 123/512, 514

[56] References Cited

U.S. PATENT DOCUMENTS

| | | | |
|---|---|---|---|
| 4,296,718 | 10/1981 | Baugh | 123/198 DB |
| 4,319,550 | 3/1982 | Ishii | 123/198 DB |
| 4,565,170 | 1/1986 | Grieshaber | 123/198 DB |
| 4,807,583 | 2/1989 | Thornwaite | 123/198 DB |
| 4,811,710 | 3/1989 | Schmitt | 123/198 DB |
| 5,076,227 | 12/1991 | Krieger | 123/198 DB |
| 5,152,265 | 10/1992 | Hummel | 123/198 DB |

FOREIGN PATENT DOCUMENTS 3934389 4/1991 Fed. Rep. of Germany .

*Primary Examiner*—Carl S. Miller

*Attorney, Agent, or Firm*—Edwin E. Greigg; Ronald E. Greigg

[57] ABSTRACT

The control apparatus has a fuel injection pump, into which suction chamber fuel is fed by a feed pump that aspirates from a tank. A reversing valve is included in the connecting lines between the tank and the fuel injection pump, and by means of this valve, to turn off the engine, the line connections can be changed such that the suction chamber communicates with the feed side of the feed pump and the compression side of the feed pump communicates with the tank. The reversing valve is embodied as a two-position multiposition valve and has an electromagnet, disposed, partly spray-coated, in the valve housing, which is of plastic, of the multiposition valve. A valve member can be displaced counter to the force of a restoring spring by the electromagnet; the valve member acts upon one ball at a time, serving as a closing body, of double seat valves disposed on both sides of the valve member. The balls are not connected to the valve member but instead are acted upon by it only upon adjustment of the valve member in one acted upon by the pressure of the fuel prevailing in the valve housing.

28 Claims, 2 Drawing Sheets

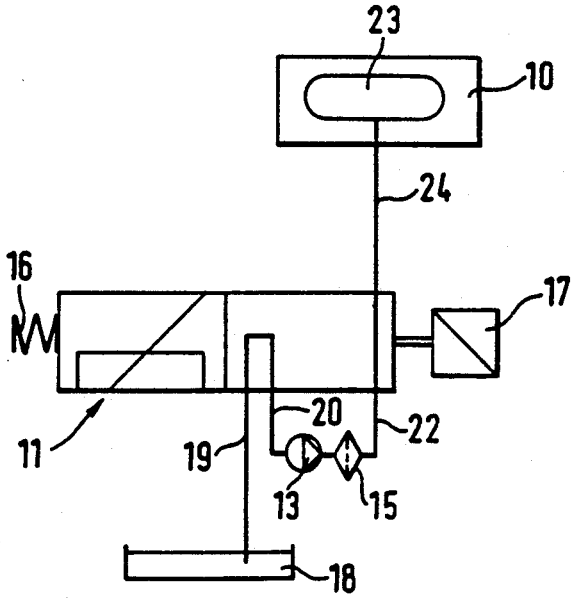
Fig. 1
Fig. 2
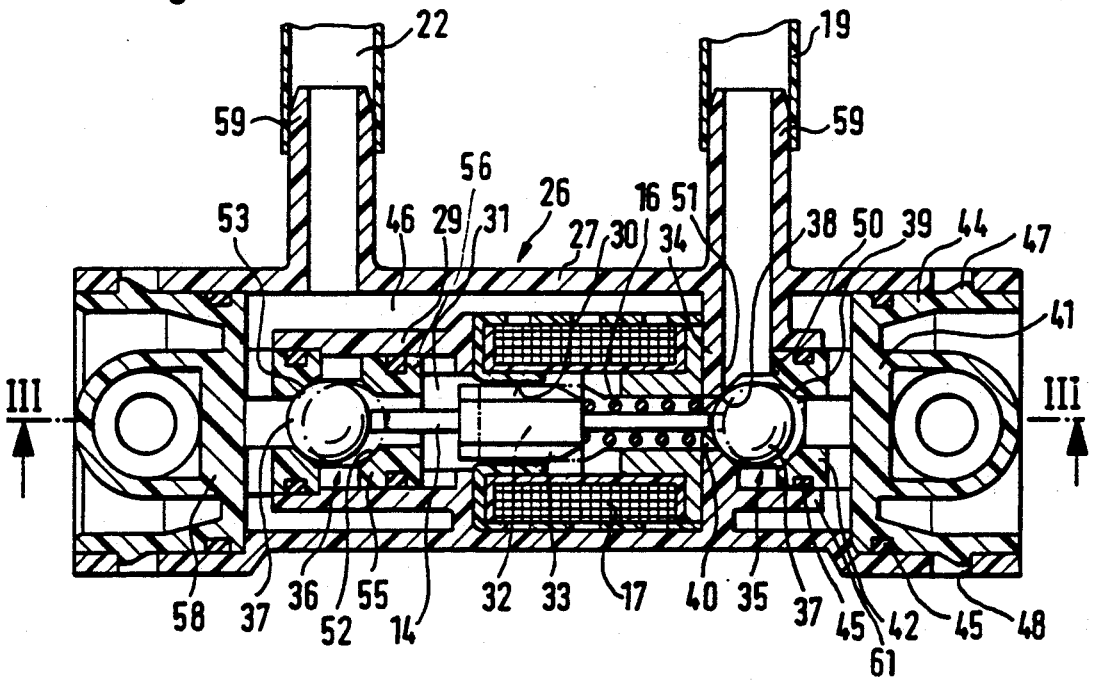

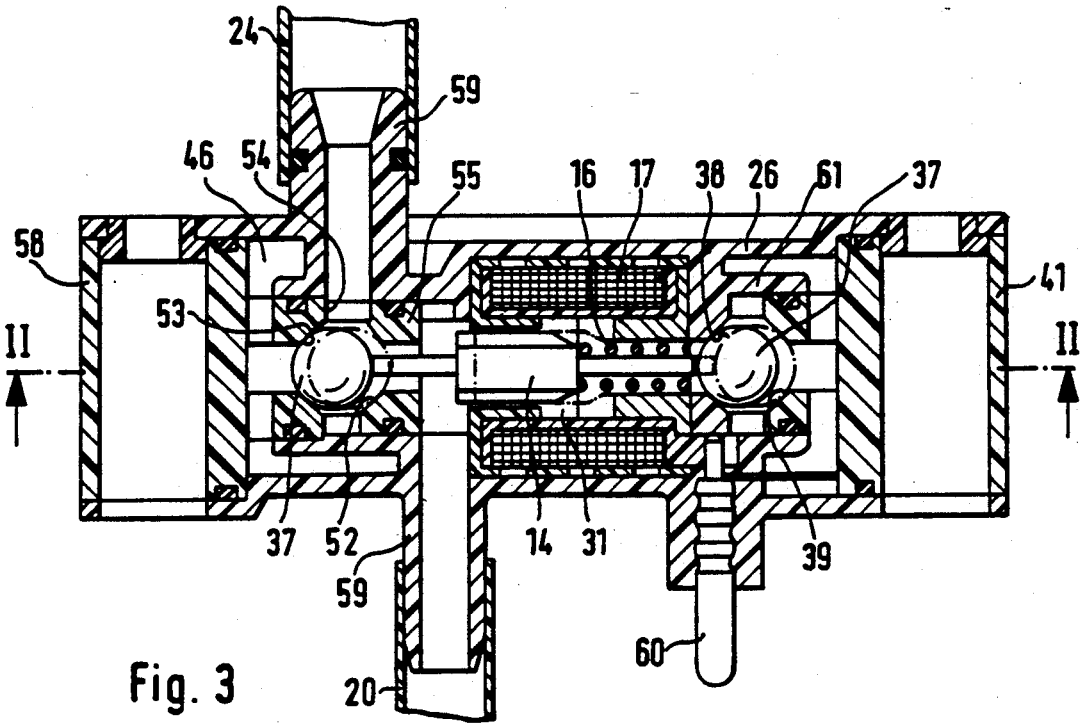
Fig. 3
Fig. 4
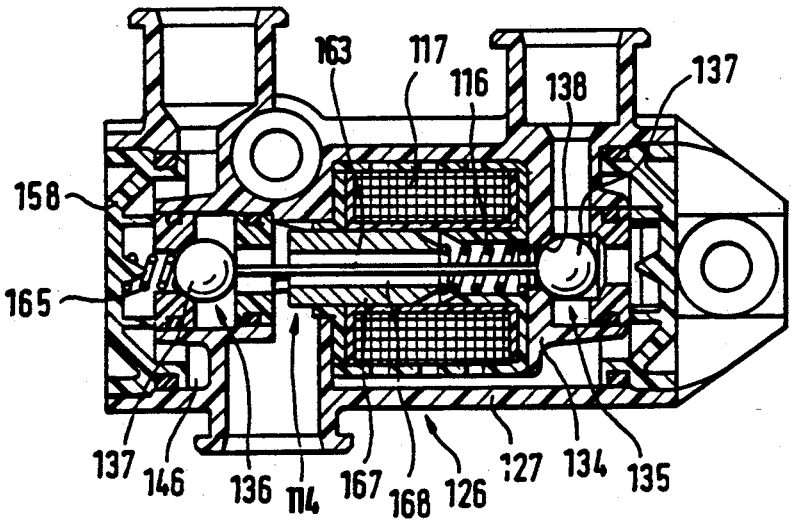

CONTROL APPARATUS FOR TURNING OFF AN INTERNAL COMBUSTION ENGINE

BACKGROUND OF THE INVENTION

The invention is directed to a control apparatus for turning off an internal combustion engine.

One such control apparatus is disclosed in German Patent Disclosure 39 34 389 A1.

This control apparatus has a fuel injection pump that is supplied with fuel by a feed pump. The control apparatus also has a reversing valve, which can be switched over between a feed position and a shutoff position. In the feed position of the reversing valve, the feed pump aspirates fuel from a tank via a tank line and a suction line, and it pumps it into the suction chamber of the fuel injection pump via a pressure line and a suction line. In the shutoff position of the reversing valve for turning off the engine, the feed pump aspirates fuel from the suction chamber of the fuel injection pump via the connecting line and the suction line and pumps it back to the tank via the pressure line and the tank line.

The reversing valve is embodied as a two-position multiposition valve and has a valve member that is disposed axially displaceably in a valve housing. The valve member has two seat valve closing bodies, each cooperating with a respective one of two valve seats formed in the valve housing and in the two positions establishing the necessary connections of the lines via control conduits as needed.

The valve member is displaceable by an electromagnet that is inserted by its face end into the valve housing, and so the reversing valve has a long structural length. The electromagnet has a separate housing, from which a pin protrudes for actuating the valve member. The reversing valve housing is of cast metal and is made in multiple parts, to enable making the control conduits and assembling the valve member and the electromagnet.

This known reversing valve is thus very complicated and expensive in construction, and many individual parts have to be assembled. Its construction needs to be changed, to make it simpler and less expensive to manufacture.

OBJECTS AND SUMMARY OF THE INVENTION

It is a principal object of the control apparatus according to the invention to provide the advantage over the prior art that in its reversing valve, the electromagnet is integrated with the valve housing; hence no separate housing is required or needs to be assembled, and its magnet armature simultaneously acts as the valve member. The reversing valve can also have a shorter structural length.

A further object and advantageous feature of the invention reside in the lines which can be connected directly to the valve housing.

Another object of the invention is to make an especially compact structure of the reversing valve possible and to provide for cooling of the electromagnet, which has a fuel flow inside and outside around it.

Yet another object allows for a simple assembly procedure of the reversing valve.

Still another object is to provide an especially simple structure of the valve member to become possible.

Yet a further object allows for a good flow through the reversing valve to be attained.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 is a simplified view of a control apparatus;

FIG. 2 shows a first exemplary embodiment of the reversing valve of the control apparatus of FIG. 1, in a longitudinal section taken along the line II—II of FIG. 3, shown in a shutoff position in solid lines and in a feed position in dashed lines;

FIG. 3 shows the reversing valve in a longitudinal section taken along the line III—III of FIG. 2, again in the shutoff position in solid lines and in the feed position in dashed lines; and FIG. 4 shows a variant of the reversing valve of FIG. 1 in longitudinal section.

DESCRIPTION OF THE PREFERRED EMBODIMENT

A control apparatus shown in FIG. 1 has a reversing valve 11, which is incorporated into the fuel circulation loop of a fuel injection pump 10, and a feed pump 13. The reversing valve 11 is embodied as a magnet valve, with a valve member 14 that can be displaced either by the force of a restoring spring 16 into a shutoff position for turning off an internal combustion engine driven with the fuel injection pump or counter to the restoring force, by an electromagnet 17, into a feed position for driving the engine. A filter 15 may be disposed downstream of the feed pump 13.

The reversing valve 11 is embodied as a 4/2-way valve, and connected to it are a tank line 19, leading away from a fuel-filled tank 18; a suction line 20 leading to the intake side of the feed pump 13; a pressure line 22 leading away from the compression side of the feed pump 13; and a connecting line 24 leading to the suction chamber 23 of the fuel injection pump 10.

The reversing valve 11 shown in FIGS. 2 and 3 has an injection-molded valve housing made of plastic. The valve housing 26 has an outer hollow cylinder 27 and an inner hollow cylinder 2 inside it, formed onto it in its middle region. The electromagnet 17, partly spray-coated with plastic, is disposed in the jacket of the inner cylinder 29, leaving a flow opening 30 for the valve member 14 free. The valve member 14 is of a magnetizable or soft-magnetic material, is larger in diameter in its middle region 32 than at both ends, is radially guided in its region 32 in the through opening 30 of the electromagnet 17, and acts as the magnet armature. In its middle region 32 having the larger diameter, the valve member 14 is provided with longitudinal slits 33. The restoring spring 16 surrounds the valve member 14 coaxially and is supported on a valve housing wall 34 that closes off the inner hollow cylinder 29 at one end. The restoring spring 16 is supported on the valve member 14 on an annular shoulder formed at the transition to the region 32. The region 32 may be embodied conically in its end portion oriented toward the restoring spring 16; in a part of the electromagnet 17 partly bordering the interior 31, a conical transition is formed, into which the end portion of the magnet armature 14 plunges upon displacement counter to the restoring spring 16.

One double seat valve 35, 36, having seat valve closing bodies shaped in the form of balls, is disposed in the region of each face end of the valve member 14. The double seat valve 35 shown on the right of the valve member 14 in FIGS. 2 and 3 has a first conical valve seat 38, which is embodied on the left toward the electromagnet 17 in the valve housing 26, and a second valve seat 39, which is likewise conical and points away from the electromagnet 17; the ball 37 cooperates with this second valve seat . The first valve seat 38 opens a connecting opening to the hollow space 31 located inside the hollow cylinder 29, for the passage of the valve member 14 to the ball 37; the valve member 14 is disposed in that hollow space 31. The connecting opening in the first valve seat 38 may be provided on its periphery with a plurality of longitudinal slits 40, so as to create support for the restoring spring 17 yet still obtain a sufficiently large flow cross section. The second valve seat 39 is embodied on a first cap part 41 inserted into the valve housing 26. Via a segment 42 of smaller diameter, this cap part 41 plunges into a cylinder neck 61 coaxially adjoining the wall 34 toward the inner hollow cylinder 29, and with a segment 44 of larger diameter, it plunges into the outer hollow cylinder 27 of the valve housing 26. The second conical valve seat 39 surrounds a connecting conduit 62, leading through the segment 42, to a hollow space 46 formed between the outer hollow cylinder 27 and the inner hollow cylinder 29. The hollow space 46 defines an annular chamber that can be can be made to communicate with a pipe neck disposed between the valve seats 38 and 39 exiting from the cylinder neck 61 via an opening 51; the pipe neck, forming a connection neck 59, extends radially away from the annular chamber 46 and to the outside through the outer hollow cylinder 27. Both segments 42 and 44 of the cap part 41 are sealed off, each by a respective sealing ring 45, 45' from the hollow cylinders 27, 29 surrounding them. On its outer jacket, the cap part 41 has at least one detent protrusion 47 protruding radially out of it, which locks into place in a corresponding recess 48 in the outer hollow cylinder 27 of the valve housing 26. In its segment 44, the cap part 41 is radially elastically deformable. In the insertion direction, the first cap part 41 comes to rest in its terminal position on a shoulder 50 formed in the valve housing 26 normal to the insertion direction.

The second double seat valve 36 likewise has two conically embodied valve seats 52 and 53. The valve seat 52 toward the electromagnet 17 is embodied on a component 55 inserted into the inner hollow cylinder 29; toward the electromagnet 17, it comes to rest in its terminal position on a shoulder 56 in the valve housing. The valve seat 52 surrounds a connection opening to the hollow chamber 31 of the inner hollow cylinder 29, which opening enables the passage through the other end of the valve member 14. Like the valve seat 39, the valve seat 52 pointing away from the electromagnet 17 is disposed on a second cap part 58 that can be inserted into the valve housing 26; this second cap part 58, embodied like the first cap part 41, can be inserted tightly into both the outer hollow cylinder 27 and the end of the inner hollow cylinder 29, and like the first cap part 41, it can be locked into place in the outer hollow cylinder 27. A connection neck 59" shown in FIG. 3 likewise leads away from the inner hollow cylinder 29 via an opening 54 between the two valve seats 52 and 53; it protrudes to the outside through the outer hollow cylinder 27. The valve seat 53 surrounds a connecting bore that connects the hollow space 46 with the opening 54.

The connection necks 59, 59', 59", 59"' for the lines 19, 20, 22 and 24 are formed onto the valve housing 26. The connection neck 59 that communicates with the tank line 19 discharges via the opening 51 of the first double seat valve 35. In the region of the second double seat valve 36, a connection neck 59' that communicates with the pressure line 22 discharges into the hollow space 46, and the connecting line 24 discharges into the opening 54 of the second double seat valve 36. The suction line 20 likewise discharges toward the fuel pump, likewise via a connection neck 59" that discharges via the outer hollow cylinder 27 into the inner hollow cylinder 29, in its interior 31 between the component 55 and the region 32 of the valve member 14. The connection necks for the connecting line 24 and the suction line 20 lead approximately diametrically oppositely away from the valve housing.

In FIGS. 1 and 2, the valve member 14 and the double seat valves 35 and 36 are shown in solid lines in a shutoff position and in dashed lines in a feed position. In the shutoff position, the electromagnet 17 is not supplied with electrical current, and the valve member 14 is pressed against the ball 37 of the second double seat valve 36 by the restoring spring 16. This keeps the ball 37 against the second valve seat 53, so that this valve seat interrupts the communication between the suction line 20 and the hollow space 46. The ball 37 is lifted from the first valve seat 52, thereby establishing communication, through that valve seat, between the suction line 20 and the connecting line 24. The ball 37 of the first double seat valve 35 is acted upon by the feed pressure of the feed pump 13 prevailing in the hollow space 46 and is pressed by this pressure against the first valve seat 38. This action interrupts the communication between the hollow space 46 and the interior 31 of the inner hollow cylinder 29 and establishes communication between the hollow space 46 and the tank line 19. In the shutoff position, the feed pump 13 aspirates fuel out of the suction chamber 23 of the fuel injection pump 10 via the connecting line 24 and through the interior 31 and the suction line 20, and pumps it back into the tank 18 through the pressure line 22, the hollow space 46 and the tank line 19.

In the feed position shown in dashed lines, the electromagnet 17 has electrical current supplied to it and it attracts the valve member 14 toward the first double seat valve 35, counter to the force of the restoring spring 16. The ball 37 of the first double seat valve 35 is held in contact with the second valve seat 39 by the valve member 14 and interrupts communication of the hollow space 46 with the tank line 19. The communication of the interior 31 of the inner hollow cylinder 29 with the tank line 19 is established through the opened first valve seat 38. The ball 37 of the second double seat valve 36 is acted upon by the feed pressure of the feed pump 13 prevailing in the hollow space 46 and is held by such pressure in contact with the first valve seat 52, so that the communication between the suction line 20 and the connection line 24 is interrupted and the communication between the hollow space 46 and the connecting line 2 is established. With the ball 37 resting on the first valve seat 38, the communication between the interior 31 and the connecting line 24 is interrupted, and the communication between the interior and the suction line 20 is established. In this position of the reversing valve 11, the feed pump 13 aspirates fuel via the tank line 19 through the interior 31 and the suction line 20, and pumps it into the suction chamber 23 of the fuel injection pump 10, through the pressure line 22, the hollow space 46 and the connecting line 24.

An adequate flow cross section is available for the fuel through the slit middle region 32 of the valve member 14, in the feed position of the reversing valve 11. The cap parts 41 and 58 and the component 55 with the valve seat 52, like the valve housing 26, are all of plastic, for instance a thermoplastic. For the electromagnet 17, electrical connection elements 60 are likewise disposed, with spray coating thereon, in the valve housing 26 and protrude to the outside.

FIG. 4 shows a variant of the reversing valve 11 of FIG. 2 in the shutoff position, in which the electromagnet 117 is disposed, partly spray-coated, inside the outer hollow cylinder 127 of the valve housing and itself forms part of the inner hollow cylinder 129. The restoring spring 116 is supported on the wall 134 in the valve housing 126, and the opening in the valve seat 138 formed on the valve housing 126 need not have any slits on its periphery, because the restoring spring 116 has a large diameter, so that an adequately large flow cross section remains.

In the double seat valve 136, through which the communication between the suction line 20 and the connecting line 24 and the communication between the pressure line 22 and the hollow space 146 are established, a spring 165 is provided for the ball 137, which is held in contact with the valve member 114 by this spring. The spring 165 is supported in the cap part 158. In this variant, the valve member 114 has an inner part 163, which has a cross section in the form of a flat rectangle, and a sheathlike jacket part 167 surrounding it, which is of a magnetizable or softmagnetic material. The jacket part 167 is provided with a through bore 168, so that an approximately semicircular flow cross section for the fuel remains free on both sides of the inner part 163 between its wide sides and the bore 168. The diameter of the bore 168 is somewhat less than the width of the inner part 163; as a result, the jacket part 167 is firmly connected to the inner part 163 by a press fit. Here, the fuel can flow through without a major flow deflection from the double seat valve 135 between the inner part 163 and the jacket part 167. In its other features, the reversing valve 111 of this variant is embodied identically to the reversing valve 11 described above.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A control apparatus for turning off an internal combustion engine, in particular a Diesel engine, having a feed pump (13) that aspirates fuel from a fuel supply container (18) via a tank line (19) and a suction line (20) and pumps it into a suction chamber (23) of a fuel injection pump (10) via a pressure line (22) and a connecting line (24); further having a reversing valve (111), embodied as a two-position multiposition valve, which in a feed position connects the tank line (19) to the suction line (20) and connects the pressure line (22) to the connecting line (24); said reversing valve has a valve member (14; 114) guided for axial movement inside a valve housing (26; 126), the valve member being displaceable by an electromagnet (17; 117) between the feed position, for operating the engine, and a shutoff position, for turning off the engine; in said shutoff position the suction chamber (23) of the fuel injection pump (10) is made to communicate with the suction line (20) of the feed pump (13) and the pressure line (22) is made to communicate with the tank line (19); the valve member further having two seat valve closing bodies (37; 137) actuatable thereby; each said valve seat closing body cooperating with two associated valve seats (38, 39; 52, 53) disposed in opposed relation; the valve housing (26; 126) comprised of plastic and produced by injection molding; the electromagnet (17; 117) disposed in the inner cylinder (29; 129) being at least partly spray-coated with plastic; and the valve member (14; 114) acting as the magnet armature.

2. A control apparatus as defined by claim 1, in which said valve housing includes connection necks (59, 59', 59'', 59''') for the lines (19, 20, 22, 24), at least some of which necks are formed integrally thereon.

3. A control apparatus as defined by claim 1, in which the electromagnet (17; 117) is disposed between the two seat valve closing bodies (37; 137), in an inner hollow cylinder (29) around which fuel flows and which is surrounded by an outer hollow cylinder (27).

4. A control apparatus as defined by claim 2, in which the electromagnet (17; 117) is disposed between the two seat valve closing bodies (37; 137), in an inner hollow cylinder (29) around which fuel flows and which is surrounded by an outer hollow cylinder (27).

5. A control apparatus as defined by claim 1, in which at least one of the valve seats (39; 53) is formed on a component (41; 55; 58) inserted detachably into the valve housing (26; 126).

6. A control apparatus as defined by claim 2, in which at least one of the valve seats (39; 53) is formed on a component (41; 55; 58) inserted detachably into the valve housing (26; 126).

7. A control apparatus as defined by claim 3, in which at least one of the valve seats (39; 53) is formed on a component (41; 55; 58) inserted detachably into the valve housing (26; 126).

8. A control apparatus as defined by claim 5, in which said component (41; 58) comprises a cap part that closes the valve housing (26; 126).

9. A control apparatus as defined by claim 6, in which said component (41; 58) comprises a cap part that closes the valve housing (26; 126).

10. A control apparatus as defined by claim 7, in which said component (41; 58) comprises a cap part that closes the valve housing (26; 126).

11. A control apparatus as defined by claim 8, in which the cap part (41; 58) can be secured to the valve housing (26; 126) by detent means (47, 48).

12. A control apparatus as defined by claim 9, in which the cap part (41; 58) can be secured to the valve housing (26; 126) by detent means (47, 48).

13. A control apparatus as defined by claim , in which the cap part (41; 58) can be secured to the valve housing (26; 126) by detent means (47, 48).

14. A control apparatus as defined by claim 1, in which seat valve closing bodies (37; 137) comprise balls, and the valve seats (38, 39; 52, 53) are embodied conically.

15. A control apparatus as defined by claim 3, in which seat valve closing bodies (37; 137) comprise balls, and the valve seats (38, 39; 52, 53) are embodied conically.

16. A control apparatus as defined by claim 5, in which seat valve closing bodies (37; 137) comprise balls, and the valve seats (38, 39; 52, 53) are embodied conically.

17. A control apparatus as defined by claim 1, in which in both positions of the reversing valve (11), only one of the seat valve closing bodies (37) at a time is held in contact with one of the valve seats (39; 53) by the valve member (14), and at that time the other seat valve closing body is freely movable.

18. A control apparatus as defined by claim 3, in which in both positions of the reversing valve (11), only one of the seat valve closing bodies (37) at a time is held in contact with one of the valve seats (39; 53) by the valve member (14), and at that time the other seat valve closing body is freely movable.

19. A control apparatus as defined by claim 5, in which in both positions of the reversing valve (11), only one of the seat valve closing bodies (37) at a time is held in contact with one of the valve seats (39; 53) by the valve member (14), and at that time the other seat valve closing body is freely movable.

20. A control apparatus as defined by claim 8, in which in both positions of the reversing valve (11), only one of the seat valve closing bodies (37) at a time is held in contact with one of the valve seats (39; 53) by the valve member (14), and at that time the other seat valve closing body is freely movable.

21. A control apparatus as defined by claim 14, in which in both positions of the reversing valve (11), only one of the seat valve closing bodies (37) at a time is held in contact with one of the valve seats (39; 53) by the valve member (14) and at that time the other seat valve closing body is freely movable.

22. A control apparatus as defined by claim 1, in which in both positions of the reversing valve (111), only one of the seat valve closing bodies (137) at a time is held in contact with one of the valve seats by the valve member (14), and at that time the other seat valve closing body is held in contact with one of the valve seats by a spring (165).

23. A control apparatus as defined by claim 3, in which in both positions of the reversing valve (111), only one of the seat valve closing bodies (137) at a time is held in contact with one of the valve seats by the valve member (14), and at that time the other seat valve closing body is held in contact with one of the valve seats by a spring (165).

24. A control apparatus as defined by claim 5, in which in both positions of the reversing valve (111), only one of the seat valve closing bodies (137) at a time is held in contact with one of the valve seats by the valve member (14), and at that time the other seat valve closing body is held in contact with one of the valve seats by a spring (165).

25. A control apparatus as defined by claim 8, in which in both positions of the reversing valve (111), only one of the seat valve closing bodies (137) at a time is held in contact with one of the valve seats by the valve member (14), and at that time the other seat valve closing body is held in contact with one of the valve seats by a spring (165).

26. A control apparatus as defined by claim 14, in which in both positions of the reversing valve (111), only one of the seat valve closing bodies (137) at a time is held in contact with one of the valve seats by the valve member (14), and at that time the other seat valve closing body is held in contact with one cf the valve seats by a spring (165).

27. A control apparatus as defined by claim 1, in which the valve member (14), to enable a flow of fuel through the reversing valves, is provided with longitudinal slits (33).

28. A control apparatus as defined by claim 1, in which the valve member (114) has an inner part (163) provided with a flat cross section; the valve member includes a medial region having a jacket part (167) provided with a through bore (168) and secured to the inner part (163); and the valve member includes an adequate flow cross section remaining free between the inner part (163) and the through bore (168).

* * * * *